US005326152A

United States Patent [19]

Baron

[11] Patent Number: 5,326,152

[45] Date of Patent: Jul. 5, 1994

[54] FOLDING LAWN CHAIR COVER

[76] Inventor: Richard K. Baron, 8216 Briarwood La., Austin, Tex. 78758

[21] Appl. No.: 2,579

[22] Filed: Jan. 11, 1993

[51] Int. Cl.[5] ..... A47C 4/34; A47C 31/10

[52] U.S. Cl. ..... 297/229; 297/183; 297/188; 297/228.1; 206/430

[58] Field of Search ..... 297/183, 188, 191, 219.1, 297/229, 228.1; 312/72; 206/430

[56] References Cited

U.S. PATENT DOCUMENTS

| | | | |
|---|---|---|---|
| 1,350,701 | 8/1920 | Burton | 312/72 X |
| 2,820,509 | 1/1958 | Moreland | 297/183 X |
| 3,151,909 | 10/1964 | Gerdetz | 297/183 X |
| 4,193,525 | 3/1980 | Sommers | 206/430 X |
| 4,687,248 | 8/1987 | Ross et al. | 297/183 X |
| 4,725,094 | 2/1988 | Greer | 297/229 |
| 4,877,288 | 10/1989 | Lee | 297/229 |
| 4,892,353 | 1/1990 | Goddard | 297/229 X |

FOREIGN PATENT DOCUMENTS

| | | | |
|---|---|---|---|
| 1116567 | 1/1982 | Canada | 206/430 |

*Primary Examiner*—Peter R. Brown
*Attorney, Agent, or Firm*—B. Noel Kivlin

[57] ABSTRACT

A cover for a folding lawn chair is provided to allow a person to conveniently carry the folding lawn chair as well as to increase comfort when the person is using the lawn chair. The cover may include an enveloped or flapped portion on each on its ends into which each end of the lawn chair can be situated. The cover thus remains in position on the lawn regardless of wind and movement by the user. The cover further includes a strap to accommodate convenient carrying of the lawn chair. The cover may finally include a pillow positioned at the head portion of the cover, a pocket for carrying magazines and other accessories, and an insulated receptacle for carrying and holding beverages such as soda and beer.

4 Claims, 4 Drawing Sheets

FOLDING LAWN CHAIR COVER

BACKGROUND OF THE INVENTION

1. Field of the Invention

This invention relates to folding lawn chairs and, more particularly, to covers and accessories for folding lawn chairs.

2. Description of the Relevant Art

Folding lawn chairs can be found in abundance along beaches, at sporting events, and within swimming pool patio areas. A wide variety of folding lawn chairs are available at most department stores, including reclining lounger-type lawn chairs and upright lawn chairs. These lawn chairs are designed to be light weight, weather resistant, and compact such that they can be carried by person or transported by automobile to a variety of outdoor locations.

Unfortunately, due in part to their compactibility and construction of weather resistant materials, lawn chairs often tend to be somewhat uncomfortable, particularly for those wearing simply swimwear garments and the like. Typical lawn chair materials do not allow one's skin to breathe, causing irritation due to perspiration. Furthermore, unsightly skin marks can be impressed upon the pressure areas of the body, frequently leading to embarrassment and ridicule. Accordingly, people often lay towels across the surface of the lawn chair to provide greater comfort and, for a similar reason, place a pillow at the head of the chair. It is not surprising, though, that as soon as the person gets out of the chair, the towel is apt to blow into the ocean, swimming pool, or other undesirable location. Similarly, the pillow is apt to slide down the elevated portion of the chair or can fall to the ground and become soiled.

Additionally, although most lawn chairs are light weight, they are still somewhat cumbersome to transport by hand. This is particularly true when a person attempts to carry more than one lawn chair at a time, or when the lawn chair is of the reclining lounger-type that includes three or more folding sections. Such difficulties worsen when the person also attempts to carry pillows, beach bags, magazines, and beverages. The endeavor initially intended for relaxation and enjoyment can thus turn to one of exhaustion and frustration.

SUMMARY OF THE INVENTION

In accordance with the present invention, a cover for a folding lawn chair is provided to allow a person to conveniently carry the folding lawn chair as well as to increase comfort when the person is using the lawn chair. The cover may include an enveloped or flapped portion on each of its ends into which each end of the lawn chair can be situated. The cover thus remains in position on the lawn chair regardless of wind and movement by the user. The cover further includes a strap to accommodate convenient carrying of the lawn chair. The cover may finally include a pillow positioned at the head portion of the cover, a pocket for carrying magazines and other accessories, and an insulated receptacle for carrying and holding beverages such as soda and beer.

These and other advantages are achieved with the present invention, in accordance with which a cover for a folding chair comprises a main cover portion formed of a material that substantially covers a seating area of the folding chair when the folding chair is in an unfolded position, means for securing the main cover portion to the folding chair, and a strap portion connected to the cover portion such that a person can support and carry the folding chair with the strap portion when the folding chair is in a folded position.

The invention will be more readily understood with reference to the drawings and the detailed description. As will be appreciated by one skilled in the art, the invention is applicable to folding chair covers in general and is not limited to the specific embodiments disclosed.

DETAILED DESCRIPTION

The following includes a detailed description of the best presently contemplated modes for carrying out the invention. The description is intended to be merely illustrative of the invention and should not be taken in a limiting sense.

Figure 1:
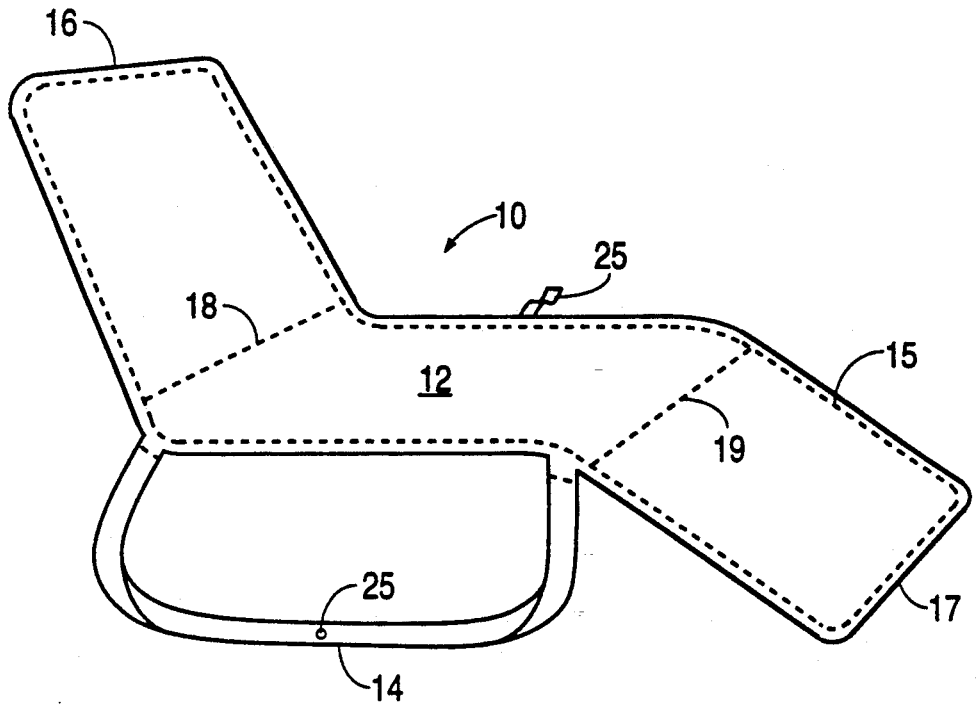
FIG. 1 is a perspective view of a cover for a folding lawn chair in accordance with a first embodiment of the present invention.

Referring first to FIG. 1, a perspective view of a cover 10 for a folding lawn chair is shown in accordance with a first embodiment of the present invention. The cover of this embodiment is adapted for use with an armless reclining lounger-type lawn chair, and includes a main cover portion 12 and a strap portion 14. Both the cover portion 12 and the strap portion 14 may be made of a cloth material such as terry, cotton, or polyester. For added strength, the strap 14 may include nylon webbing surrounded by terry cloth. A seam 15 is formed along the entire perimeter of the cover 12, and each end 16 and 17 of the cover 12 is formed with a folded-over layer of cloth that establishes a pair of envelopes or flaps 18 and 19 into which the top and bottom ends of a folding lawn chair may be inserted. The strap portion 14 is sewn to the cover 12 along the openings of envelopes 18 and 19 and is fabricated to have an appropriate length to allow support of the lawn chair over a person's shoulders. A fastener assembly 25 may further be provided with corresponding mating parts on the strap portion 14 and the opposite side of the cover portion 12.

Figure 2:
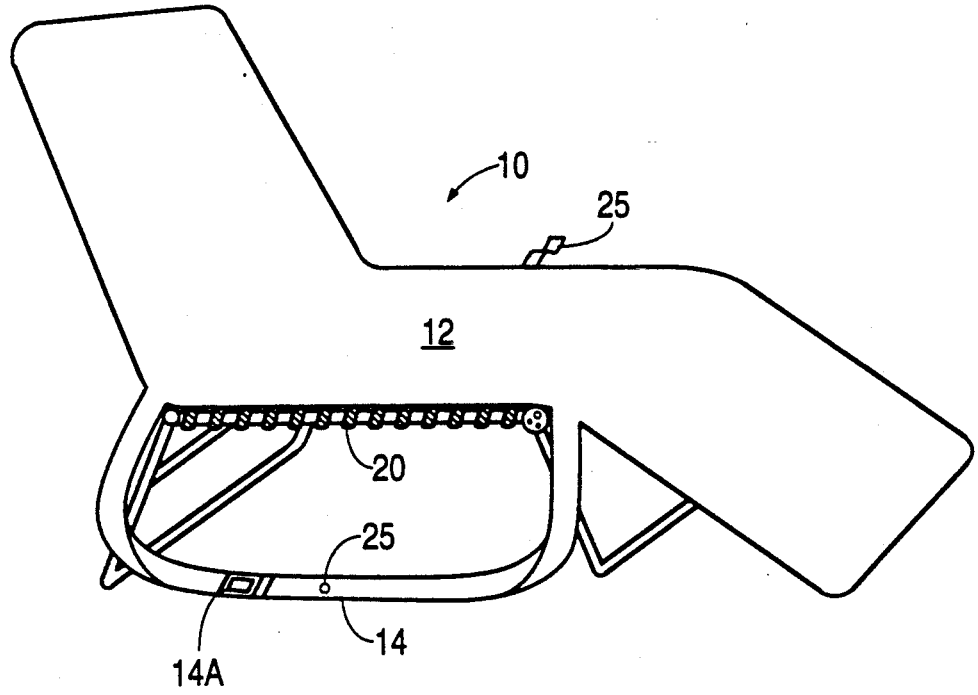
FIG. 2 is a perspective view of a folding lawn chair including a cover in accordance with the first embodiment of the present invention.

Referring next to FIG. 2, a perspective view of the cover described above is shown situated upon a folding lawn chair 20. It is evident that the mid-section of the strap portion 14 may be extended beneath the lawn chair 20 to allow connection of the connecting assembly 25. The cover 10 is thereby more securely fastened to the lawn chair 20, and strap 14 will not interfere with people's movement near the chair. As will be appreciated by frequent users of such lawn chairs, a person may relax comfortably within this lawn chair while in swimwear garment and the like, and will not be irritated by perspiration or marked with unsightly skin indentations. Furthermore, the cover will not blow away by wind since it is effectively secured to the lawn chair 20 by flaps 18 and 19.

The strap portion 14 may alternatively be equipped with a buckle device 14A that allows the length of the strap to be adjusted. As such the buckle device 14A can be used to tighten the strap 14 flush with the side of the chair such that the strap portion 14 will not interfere with movement.

Figure 3:
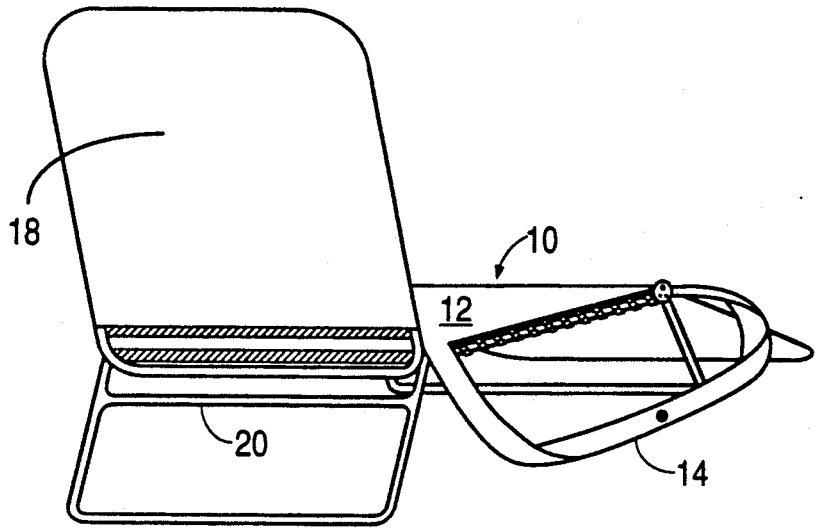
FIG. 3 is a back-side perspective view of the folding lawn chair including the cover.

FIG. 3 is a perspective back-side view of the lawn chair 20 equipped with the cover 10. This view illustrates the positioning of the top end of the lawn chair 20 within the upper flap 18 of cover 10.

Figure 4:
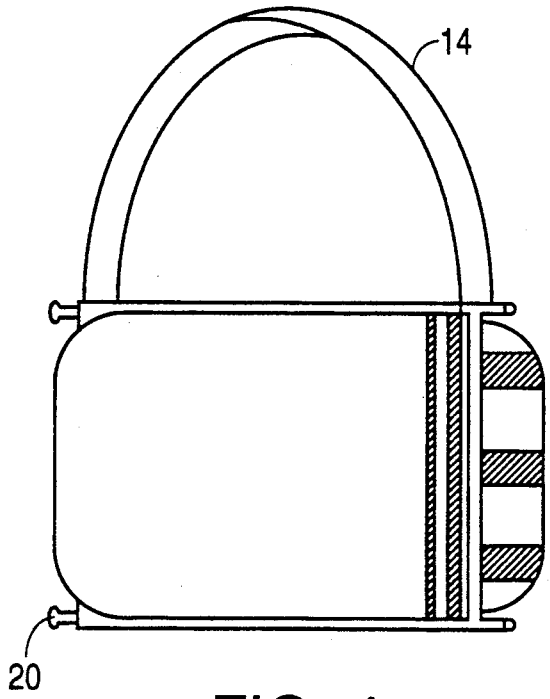
FIG. 4 is a perspective view of the folding lawn chair in its folded position including the cover.

FIG. 4 is a perspective view of the cover 10 while the lawn chair 20 is in its folded position. It is noted that the carrying strap 14 allows a person to conveniently carry the lawn chair 20 by supporting the carrying strap over his shoulder.

Figure 5:
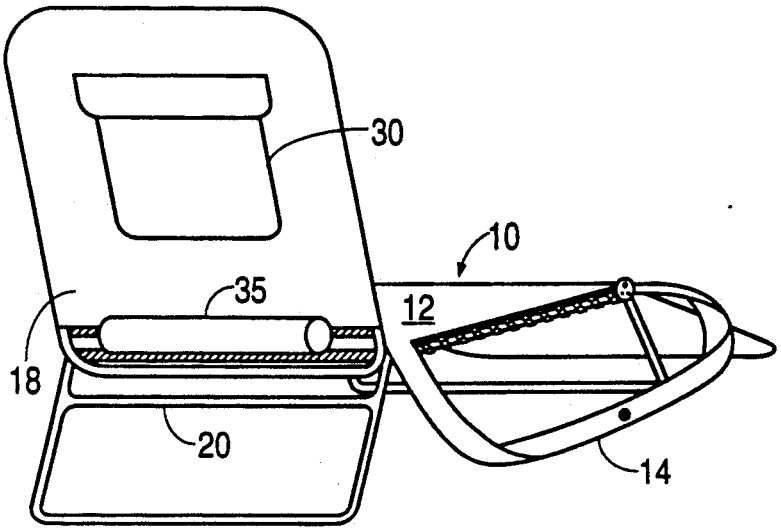
FIG. 5 is a perspective view of the folding lawn chair equipped with a cover according to a second embodiment of the present invention.
Figure 6:
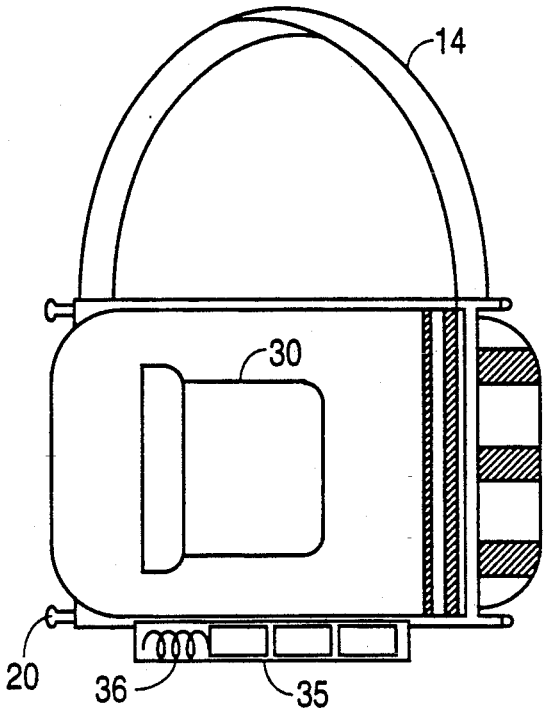
FIG. 6 is a perspective view of the folding lawn chair in its folded position including the cover in accordance with the second embodiment.

Referring next to FIGS. 5 and 6, a second embodiment of the present invention is shown. The embodiment of FIGS. 5 and 6 is similar to that of FIGS. 1–4, and corresponding elements thereof are numbered identically. The cover 10 of FIG. 3 is further formed with a pouch 30 to accommodate magazines or other accessories such as sun tanning lotion. An opening of the pouch 30 may be incorporated with a zipper or Velcro to prevent items from dropping out of the pouch while the lawn chair is transported.

The embodiment of FIGS. 5 and 6 also includes a beverage holder 35 having a lid and a cylindrical receptacle capable of receiving soda and beer cans or bottles. The beverage holder 35 may be formed by an insulating styrofoam or plastic shell. It is noted that the beverage holder 35 may be secured to the lowermost end of the flap 18 as shown in FIG. 5 or to the mid-section of the cover 12 as shown in FIG. 6 such that a person sitting in the folding lawn chair 20 can conveniently remove a can or bottle without leaving the chair. A spring 36 may be inserted within the cylindrical receptacle to facilitate convenient removal of the beverages.

Figure 7:
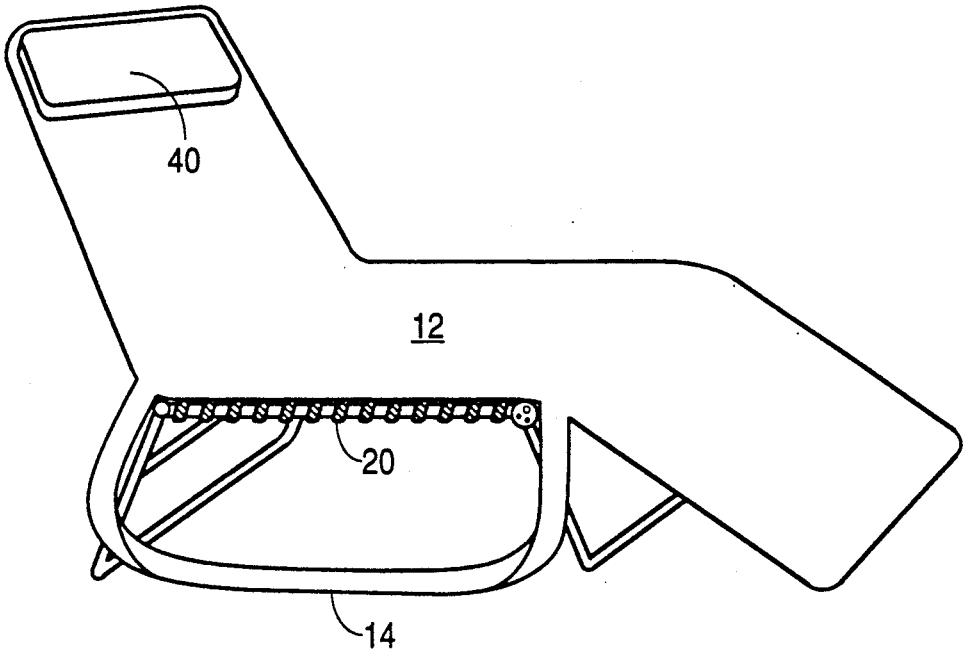
FIG. 7 is a perspective view of the folding lawn chair including a cover in accordance with a third embodiment of the present invention.

Referring finally to FIG. 7, a cover 10 according to the present invention may also be equipped with a head pad 40 positioned at the upper end of the cover portion 12. The head pad 40 may be fabricated using foam such as styrofoam or some other cushioning material (i.e., foam rubber) housed by the same cloth material forming the cover portion 12.

It is noted that although the embodiments described above utilize flap portions 18 and 19 to secure the cover 10 to a folding lawn chair, other attachment means could be used such as straps and buckles that secure to the frame of a folding lawn chair. Furthermore, other embodiments of the cover may be provided that are specifically adapted for use with upright-style lawn chairs.

Numerous modifications and variations will become apparent to those skilled in the art once the above disclosure is fully appreciated. It is to be understood that the above detailed description of the preferred embodiments is intended to be merely illustrative of the spirit and scope of the invention and should not be taken in a limiting sense. The scope of the claimed invention is better defined with reference to the following claims.

What is claimed is:

1. A cover for a folding lounge chair including a seat portion, a leg-rest portion, and a back-rest portion, said cover comprising:

a main cover formed of a material that substantially covers said seat portion, said leg-rest portion, and said back-rest portion of said folding lounge chair, wherein said main cover includes a first end, a second end, and a first side that extends between said first end and said second end;

a first flap formed in the proximity of said first end of said main cover for securing said main cover to said back-rest portion of said folding lounge chair;

a second flap formed in the proximity of said second end of said main cover for securing said main cover to said leg-rest portion of said folding lounge chair; and a shoulder strap attached at a first location along said first side of said main cover and at a second location along said first side of said main cover such that a person can support and carry said folding lounge chair with said shoulder strap when said folding lounge chair is in a folded position.

2. The cover for a folding lounge chair as recited in claim 1 further comprising a pouch formed on said first flap.

3. The cover for a folding lounge chair as recited in claim 1 further comprising a beverage holder connected to said main cover.

4. The cover for a folding lounge chair as recited in claim 1 wherein said first and second flaps accommodate the insertion of a top end and a bottom end of said folding lounge chair.

* * * * *